US006595864B2

(12) United States Patent
Fuller

(10) Patent No.: US 6,595,864 B2
(45) Date of Patent: Jul. 22, 2003

(54) PUTTING PRACTICE DEVICE

(76) Inventor: Ernest Fuller, 8670 PGA Dr., Walled Lake, MI (US) 48390

( * ) Notice: Subject to any disclaimer, the term of this patent is extended or adjusted under 35 U.S.C. 154(b) by 0 days.

(21) Appl. No.: 09/884,572

(22) Filed: Jun. 19, 2001

(65) Prior Publication Data

US 2002/0193172 A1 Dec. 19, 2002

(51) Int. Cl.[7] ..... A63B 69/36
(52) U.S. Cl. ..... 473/188; 273/127 B
(58) Field of Search ..... 473/186–189, 473/180; 273/127 B

(56) References Cited

U.S. PATENT DOCUMENTS 1,297,055 A * 3/1919 Austin ..... 273/127 B
1,939,142 A * 12/1933 Seymour ..... 273/127 B
2,899,207 A * 8/1959 Billinghurst ..... 273/127 B
3,313,544 A * 4/1967 Davis ..... 273/127 B
3,458,202 A * 7/1969 McNamara ..... 273/127 R
3,512,783 A * 5/1970 Anderson ..... 175/8
3,909,007 A * 9/1975 Wuertemburg et al. ..... 473/188
4,007,938 A * 2/1977 Guenther ..... 473/188
4,691,922 A * 9/1987 Peel et al. ..... 473/188
6,283,873 B1 * 9/2001 Nunes ..... 473/180
6,287,213 B1 * 9/2001 Selton ..... 473/180

* cited by examiner

*Primary Examiner*—Mark S. Graham
(74) *Attorney, Agent, or Firm*—Harness, Dickey & Pierce, P.L.C.

(57) ABSTRACT

A putting practice device having a first circular plate being generally parallel to and vertically offset from a second circular plate. The second circular plate is positionable upon a putting surface. The first circular plate and the second circular plate are spaced apart from each other by an intermediate circular member. This arrangement defines a golf ball receiving channel, which is capable of receiving and retaining a golf ball therein.

14 Claims, 3 Drawing Sheets

3

50
10
58
40
12
16
60
100
48
14
3

PUTTING PRACTICE DEVICE

FIELD OF THE INVENTION

The present invention generally relates to golf putting practice devices and, more particularly, to a golf putting practice device that is capable of reducing turf damage on practice putting greens and is capable of facilitating quick and convenient repositioning of putting practice holes.

BACKGROUND OF THE INVENTION

Putting greens on most golf courses are provided with holes which meet the specifications of the United States Golf Association ("USGA"). A standard USGA golf hole has a diameter of 4.25 inches. Generally, each putting green on a golf course is configured to challenge the golfer and, thus, the position of the hole on the green is changed regularly to continually offer the golfer new challenges. As a result, putting is a critical aspect of every golfer's game. A golfer can significantly improve his score by decreasing the number of strokes he must take to putt a golf ball into a golf hole. However, learning to control the golf ball so that it sinks into the hole within a minimum number of strokes is very difficult. Therefore, golfers frequently practice these putting strokes on practice putting greens provided at most golf courses. As on the golf course, the position of these holes on the practice putting green are changed regularly to continually offer the golfer new practice challenges. Moreover, the position of these holes are changed regularly to minimize tread damage on the practice putting greens caused by the frequent walking of golfers in and around practice putting holes. Traditionally, practice puffing greens include a number of practice putting holes to enable multiple golfers to practice simultaneously. These multiple hole locations permit a single golfer to experience various putting challenges on a single practice putting green.

In order to move the position of a putting cup, greens keepers typically use a coring device to cut a hole into the putting surface. The coring device then removes a turf core from the putting surface to enable the greens keeper to insert a cup liner therein. The turf core is then used to plug the older putting hole. It should be appreciated that this coring technique may disrupt or traumatize the delicate grasses typically used on putting greens. This problem is compounded on a practice putting green where the number of putting holes and foot traffic are dramatically increased.

Accordingly, there exists a need in the relevant art to provide an improved putting practice device that can minimize turf damage experienced in a practice putting green. Moreover, there exists a need in the relevant art to provide a putting practice device capable of being quickly and conveniently repositioned to continually offer the golfer new putting challenges. Furthermore, there exists a need in the relevant art to overcome the disadvantages of the prior art technique.

SUMMARY OF THE INVENTION

In accordance with the broad teachings of this invention, a putting practice device having an advantageous construction is provided. The putting practice device includes a first circular plate being generally parallel to and vertically offset from a second circular plate. The second circular plate is positionable upon a putting surface. The first circular plate and the second circular plate are spaced apart from each other by an intermediate circular member. The intermediate circular member has an outer diameter that is less than the outer diameter of the first circular plate and second circular plate. This arrangement defines a golf ball receiving channel, which is capable of receiving and retaining a golf ball therein.

Further areas of applicability of the present invention will become apparent from the detailed description provided hereinafter. It should be understood that the detailed description and specific examples, while indicating preferred embodiments of the invention, are intended for purposes of illustration only.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
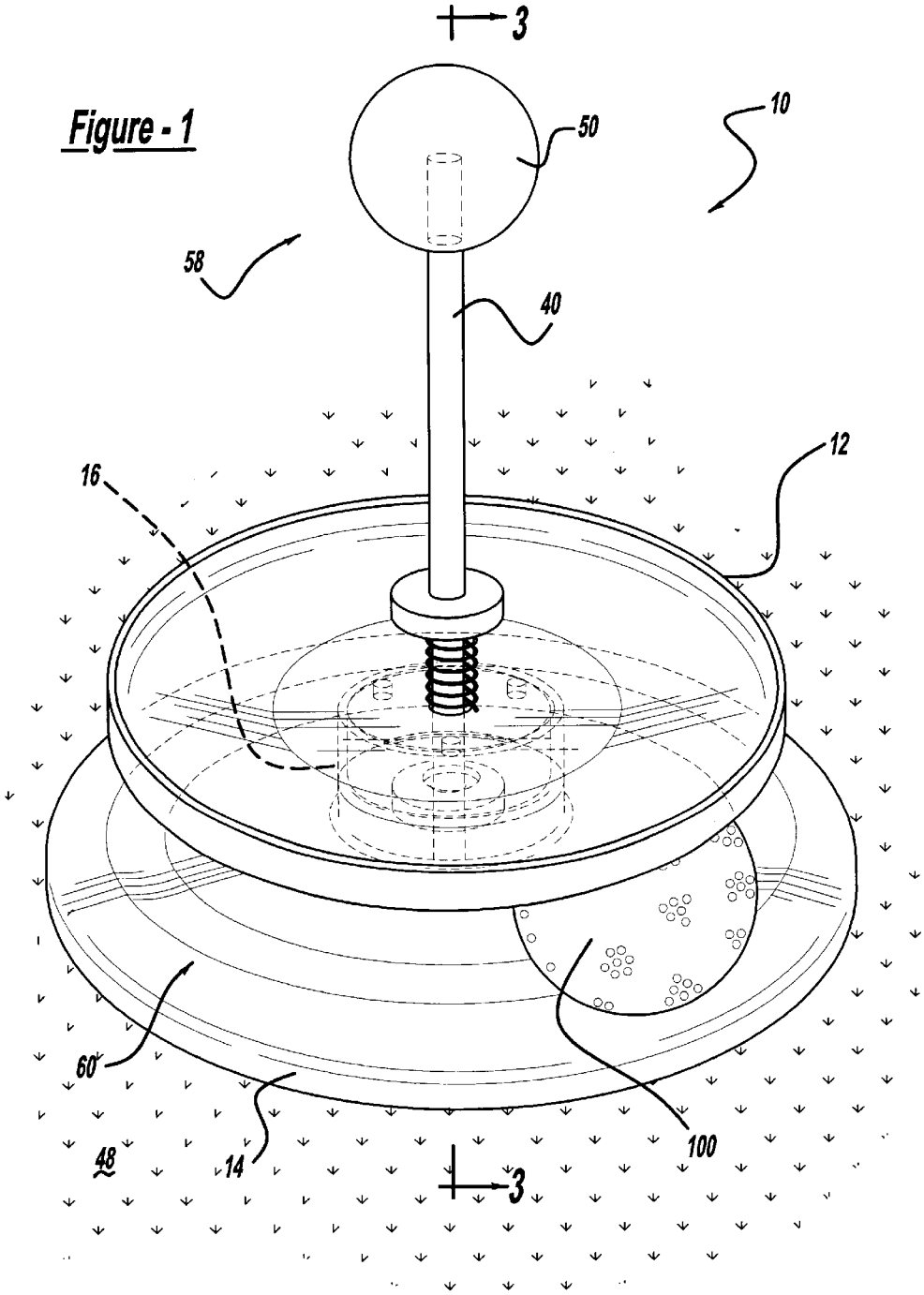
FIG. 1 is a perspective view of a putting practice device according to the principles of the present invention.
Figure 2:
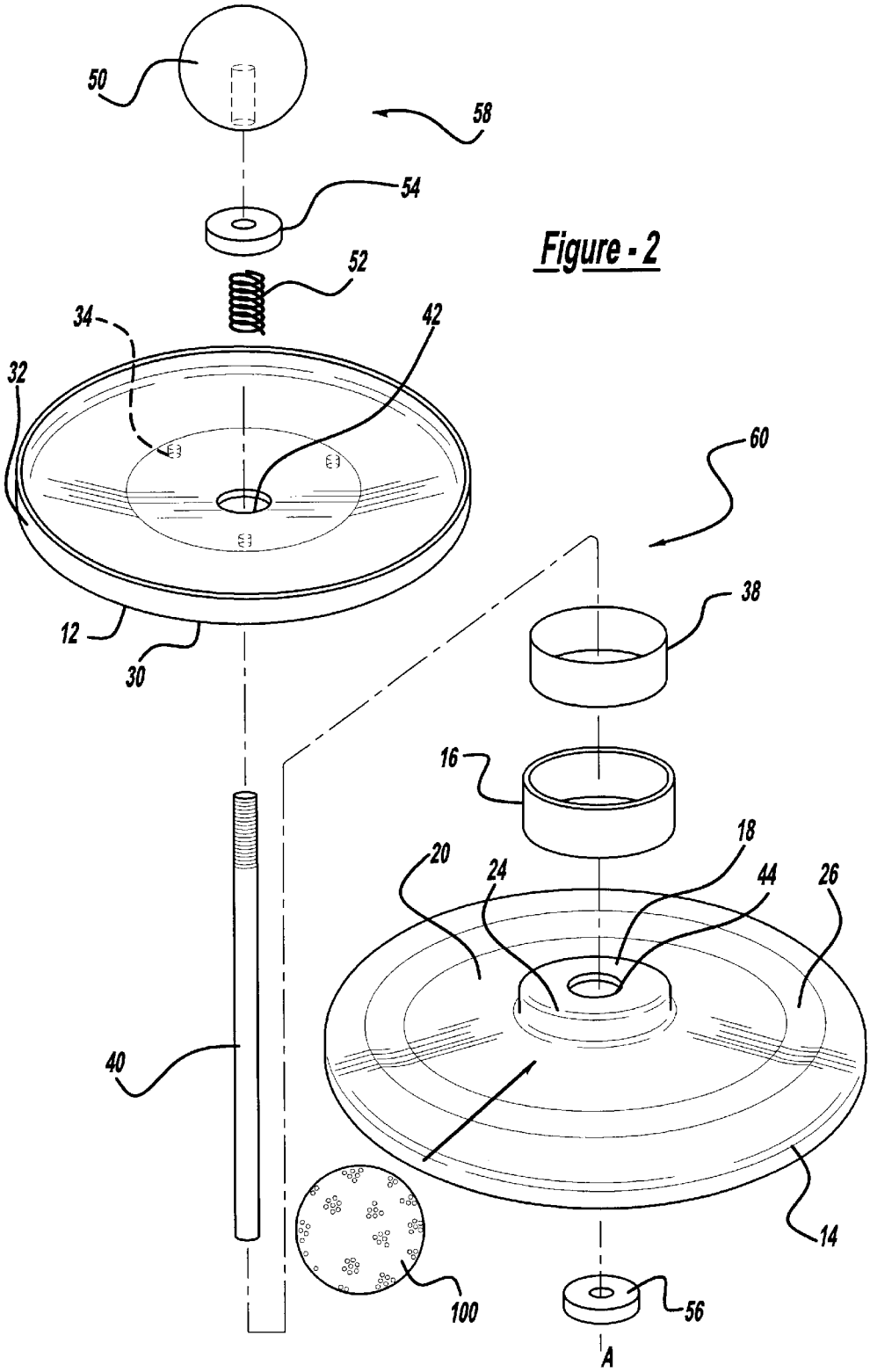
FIG. 2 is an exploded perspective view of the putting practice device.

The following description of the preferred embodiment is merely exemplary in nature and is in no way intended to limit the invention, its application, or uses.

Referring to the drawings, a putting practice device 10 is shown having an upper plate 12, a lower plate 14, and an intermediate ring member 16. As will be described in detail, upper plate 12, lower plate 14, and intermediate ring member 16 cooperate to frictionally retain a golf ball to simulate a regulation size putting hole. The putting practice device 10 of the present invention is particularly well adapted for use in traditional putting greens and home/office use.

Figure 3:
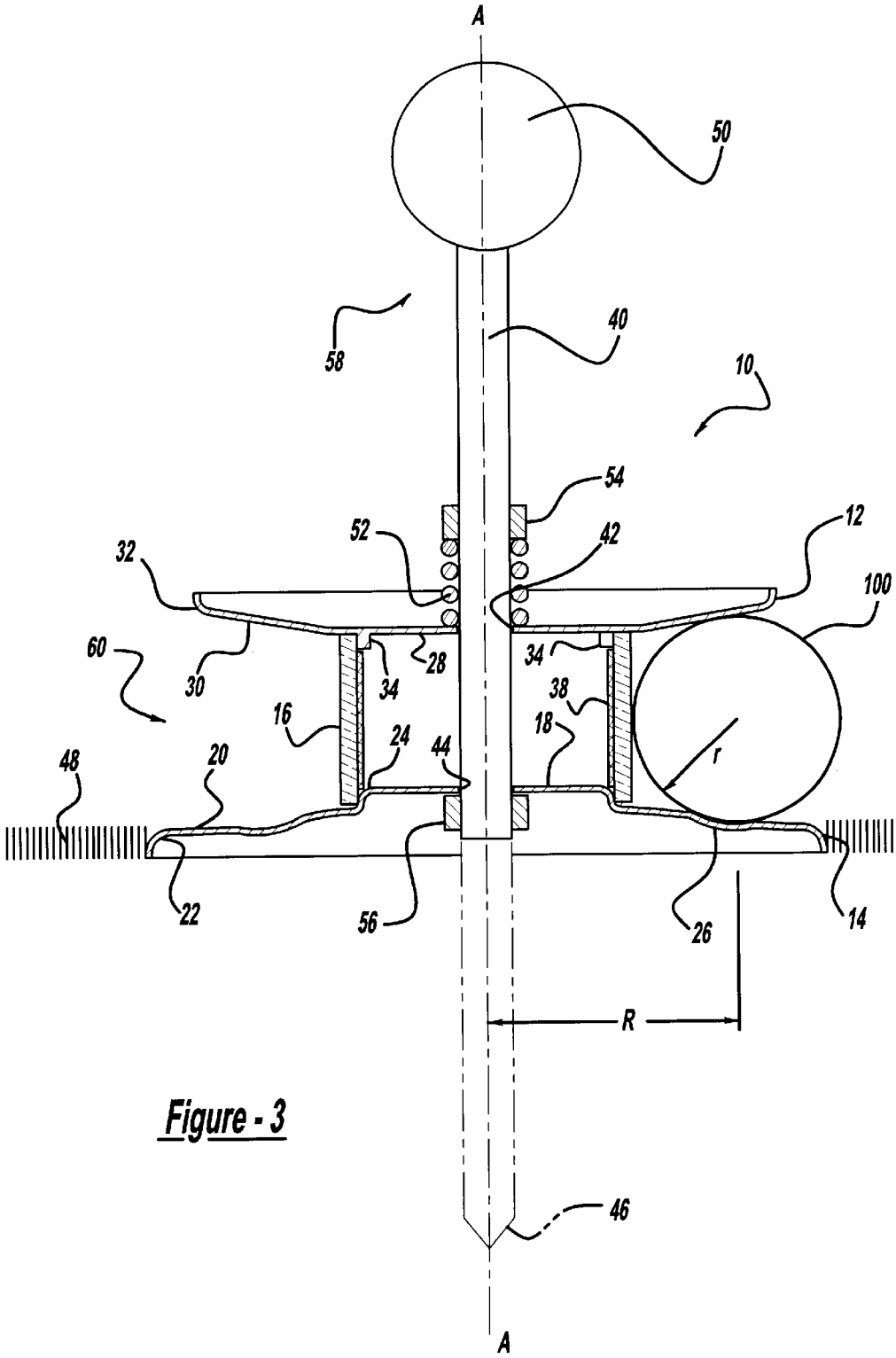
FIG. 3 is a side view, with portions in cross-section, of the putting practice device taken along line 3—3 of FIG. 1.

As best seen in FIG. 3, lower plate 14 is generally a circularly shaped declined member having a centrally located planar portion 18, which extends into a generally declined retaining surface 20. Generally declined retaining surface 20 terminates at a downwardly turned edge 22. Lower plate 14 is preferably made of a non-corrosive material, such as, but not limited to, plastic, fiberglass, or stainless steel. It should be noted that centrally located planar portion 18 is raised relative to declined retaining surface 20 to form a circular shoulder 24 for cooperation with intermediate ring member 16.

Lower plate 14 further includes a retaining groove 26. Retaining groove 26 is a concave arcuate depression circularly formed in lower plate 14 generally about a longitudinal axis A—A. Preferably, the radius of curvature r of groove 26 generally equals the radius R of a regulation golf ball 100 and the radius of groove 26 about longitudinal axis A—A preferably conforms to USGA Cup Regulations (namely, 2⅛" radius). Furthermore, groove 26 is preferably painted white to provide a visual cue to the golfer of the cup position and to further facilitate the active practice of the putting stroke.

Similarly, as best seen in FIG. 3, upper plate 12 is generally a circularly shaped inclined member having a centrally located planar portion 28, which extends into a generally inclined engaging surface 30 extending radially outward from planar portion 28 about longitudinal axis A—A. Inclined engaging surface 30 terminates into an upwardly turned edge 32. Preferably, inclined engaging surface 30 of upper plate 12 is inclined at an angle of between 12° and 15° relative to planar portion 28. It should be noted that planar portion 28 further includes at least three locating nubs 34. Nubs 34 cooperate with intermediate ring member 16 to retain intermediate ring member 16 in a fixed position. However, it is important to note that nubs 34 may be replaced with a similarly shaped raised planar surface similar to surface 18 of lower plate 14. Alternatively, nubs 34 and raised planar surface 18 may be replaced by integrally forming intermediate ring member 16 with either upper plate 12 or lower plate 14. Conceivably, upper plate 12, lower plate 14, and intermediate ring member 16 could all be formed as a single unit provided the distance between upper plate 12 and groove 26 are sufficiently maintained to ensure a proper fit with golf ball 100. Accordingly, such connection should not be interpreted to limit the scope of this invention.

As illustrated in the figures, intermediate ring member 16 is a generally hollow cylindrical member. The outer diameter of intermediate ring member 16 is sized such that when a golf ball 100 (FIG. 11) is putted accurately toward putting practice device 10, golf ball 100 will be wedged between upper plate 12 and groove 26 of lower plate 14. Intermediate ring member 16 will further center golf ball 100 within groove 26 of lower plate 14. Accordingly, golf ball 100 is held in place by putting practice device 10, assuming the practice putt was accurately directed toward lower plate 14. However, in the interest of manufacturing simplicity, upper plate 12, lower plate 14, and intermediate ring member 16 are each manufactured separately from each other. Centrally located planar portion 18 of lower plate 14 and nubs 34 of upper plate 12 ensure that intermediate ring member 16 is properly positioned and centered relative to upper plate 12. Preferably, intermediate ring member 16 is made of a clear material, such as acrylic, so as to permit a display member 38 to be positioned within intermediate ring member 16. Display member 38 includes writing, logo, or other display located thereon that is readable by the golfer. By way of non-limiting example, such display may include a hole number, sponsor's logo, or color-coding.

Putting practice device 10 further includes an elongated rod 40 extending through an aperture 42 formed in upper plate 12 and an aperture 44 formed in lower plate 14. For putting green use, elongated rod 40 continues downwardly from lower plate 14 and terminates in a tapered end 46 (shown in phantom in FIG. 3). The portion of elongated rod 40 extending below lower plate 14, including tapered end 46, may be inserted into a putting surface 48, such as a practice putting green. It should be appreciated that by inserting elongated rod 40 into putting surface 48, minimal damage is caused to the putting surface. Moreover, the action of inserting and removing putting practice device 10 from putting surface 48 serves to aerate putting surface 48. Preferably, elongated rod 40 is made of a non-corrosive material, such as fiberglass, plastic, or stainless steel.

Alternatively, for indoor use, elongated rod 40 may terminate at some point below aperture 44 of lower plate 14 yet above a plane defined by downwardly turned edge 22. Accordingly, putting practice device 10 can sit flatly on a surface, such as a hard floor, carpeted surface, or in conjunction with a manufactured putting surface, which is typically used for indoor putting practice. However, lower plate 14 should remain generally flush with the level of the indoor putting surface to permit proper roll and capture of the golf ball within the putting practice device.

The portion of elongated rod 40 that extends above upper plate 12 includes a knob 50. Knob 50 is fixedly mounted to elongated rod 40 using conventional means, such as a threaded engagement. However, knob 50 may be formed integrally with elongated rod 40. Knob 50 is used as a gripping device to allow a golfer to lift putting practice device 10 from putting surface 48 to easily remove golf ball 100 from putting practice device 10. Knob 50 is then further used to aid in the reinsertion of putting practice device 10 into putting surface 48.

A spring 52 surrounds elongated rod 40 and extends between upper plate 12 and a retaining feature 54. Retaining feature 54 is preferably a plastic collar that is fixed to elongated rod 40 in a conventional manner, such as by gluing. Knob 50 may also be used as a retaining feature. Spring 52 biases upper plate 12 against intermediate ring member 16 and lower plate 14. Another retaining feature 56 is positioned below lower plate 14 to act against the biasing force of spring 52, thereby preventing movement of lower plate 14 relative to elongated rod 40. Retaining feature 56 may be any fastener capable of preventing this movement, such as a crimp formed in elongated rod 40, a plastic collar, or a clevis-type pin. Preferably, a secondary support plate (not shown) is provided between retaining feature 56 and lower plate 14 to aid in maintaining the level position of lower plate 14. However, retaining feature 56 may be adequately sized (as shown) to maintain the level position of lower plate 14.

It should be noted that the upper portion of elongated rod 40 and knob 50, which together form a handle 58, may be replaced with other handle-type devices. These alternative handle designs may simply be mounted to the top of upper plate 12 so long as they enable quick and convenient retrieval of golf balls and repositioning of the putting practice device. If an alternative handle design is employed, it may be necessary to reposition spring 52 to a new location. That is, spring 52 could be positioned along elongated rod 40 below lower plate 14. This arrangement would require an additional retaining feature, such as a crimp or clevis-type pin, to be used near tapered end 46 of elongated rod 40. The spring 52 would then bias lower plate 14 against intermediate ring member 16 and upper plate 12. It would also be necessary to prevent the relative movement of upper plate 12 relative to spring 52.

In operation, putting practice device 10 is inserted into putting surface 48. To this end, a greens keeper would grasp knob 50 and drive tapered end 46 of elongated rod 40 into and perpendicular to putting surface 48. Putting practice device 10 would be inserted such that downwardly turned edge 22 of lower plate 14 rests upon putting surface 48 (FIG. 1). A golfer may then attempt to putt golf ball 100 toward putting practice device 10. If the putting stroke is accurate, golf ball 100 will be propelled up inclined engaging surface 30 of lower plate 14. Simultaneously, golf ball 100 will be forced within groove 26 of upper plate 12 until such time that golf ball 100 impacts against intermediate ring member 16. At this time, golf ball 100 is then retained within a golf ball receiving channel 60 defined by lower plate 14, intermediate ring member 16, and groove 26 of upper plate 12. Golf ball receiving channel 60 simulates the characteristics of putting into a conventional hole in that if the putting stroke is too hard, the golf ball will ricochet out of golf ball receiving channel 60. When putting into a conventional hole, if a putting stroke is too hard, then the golf ball is likely to "lip" out of the cup or bounce off of the far edge of the cup. Therefore, the golfer will be required to gauge the speed necessary to successfully lodge golf ball 100 within golf ball receiving channel 60. Once golf ball 100 is lodged within golf ball receiving channel 60, then a golfer may simply remove putting practice device 10 from putting surface 48 using knob 50 to facilitate removal of golf ball 100. Alternatively, golf ball 100 may be removed using a light tap of the putter blade or grip end. Putting practice device 10 is then reinserted into putting surface 48 for further putting practice. Spring 52 applies the necessary force against upper plate 12 so as to enable upper plate 12 to float relative to lower plate 14, yet retain golf ball 100 within golf ball receiving channel 60 when a successful putting stroke is made.

It should be appreciated from the above description that the putting practice device of the present invention successfully overcomes the disadvantages of the coring technique when used on practice putting greens. Moreover, the putting practice device of the present invention enables quick and convenient repositioning of the "putting hole" to continually offer the golfer new putting challenges.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A putting practice device comprising:

a top plate defining an top plane;

a bottom plate defining a bottom plane, said bottom plane being generally parallel to and vertically offset from said top plane, said bottom plate being positionable upon a putting surface, said bottom plate having a ball retaining groove;

an intermediate circular member positioned between said top plate and said bottom plate, an outer diameter of said intermediate circular member being less than an outer diameter of said top plate and said bottom plate;

a spring biasing said top plate and said bottom plate together, wherein said groove of said bottom plate, said top plate, said intermediate circular member, and said spring cooperate to define a golf ball receiving channel, said golf ball receiving channel being capable of selectively retaining a golf ball therein;

an elongated stake member extending perpendicularly from said bottom plate, said elongated stake member engageable with said putting surface for preventing movement of the putting practice device; and a handle coupled with said top plate, said handle aiding in the removal of said putting practice device from said putting surface;

wherein said handle is an elongated post extending generally perpendicularly from said top plate, said elongated post having a knob disposed at an opposing end thereof from said top plate, said spring acting between said knob and said top plate.

2. The putting practice device according to claim 1 wherein the diameter of said groove is substantially the same as a conventional golf hole.

3. A putting practice device comprising:

a first circular plate member defining a first plane;

a second circular plate member defining a second plane;

a generally transparent intermediate member positioned between said first circular plate member and said second circular plate member, an outer diameter of said intermediate member being less than an outer diameter of said first circular plate member and said second circular plate member;

an elongated post handle extending generally perpendicularly from said first circular plate member, said elongated post handle aiding in the removal of said putting practice device from said putting surface;

a spring biasing said first circular plate member and said second circular plate member together, said spring extending between said elongated post handle and said first circular plate member; and a display member disposed within said generally transparent intermediate member, said display member having an indicia viewable through said generally transparent intermediate member, wherein said first circular plate member, said second circular plate member, and said intermediate circular member cooperate to define a golf ball receiving channel, said golf ball receiving channel being capable of selectively retaining a golf ball therein.

4. The putting practice device according to claim 3 wherein said indicia is chosen from the group consisting essentially of writings, colors, logos, and hole numbers.

5. The putting practice device according to claim 3, further comprising:

an elongated stake member extending perpendicularly from said second circular plate member, said elongated stake member engageable with the putting surface for preventing movement of the putting practice device.

6. The putting practice device according to claim 3, further comprising:

a groove formed in said second circular plate member, said groove cooperating with said first circular plate member to retain said golf ball in said golf ball receiving channel.

7. The putting practice device according to claim 6 wherein a central diameter of said groove is substantially the same as a conventional golf hole.

8. The putting practice device according to claim 3 wherein said intermediate circular member is formed integrally with one of said first circular plate member and said second circular plate member.

9. A putting practice device comprising:

a upper member defining an upper plane;

a lower member defining a lower plane;

a generally transparent intermediate circular member positioned between said upper member and said lower member, an outer diameter of said intermediate circular member being less than an outer diameter of said upper member and said lower member, wherein said upper member, said lower member, and said intermediate circular member cooperate to define a golf ball receiving channel, said golf ball receiving channel being capable of selectively retaining a golf ball therein;

an elongated stake member extending perpendicularly from said lower member, said elongated stake member engageable with said putting surface for preventing movement of the putting practice device;

a retaining feature extending from said elongated stake member; and a spring biasing said top plate and said bottom plate together, said spring extending between said retaining feature and said upper member.

10. The putting practice device according to claim 9 wherein said retaining feature is a knob coupled to said elongated stake member.

11. The putting practice device according to claim 9 wherein said retaining feature is a collar coupled to said elongated stake member.

12. The putting practice device according to claim 9 further comprising:

a groove formed in said lower member, said groove cooperating with said upper member to retain said golf ball in said golf ball receiving channel.

13. The putting practice device according to claim 12 wherein a central diameter of said groove is substantially the same as a conventional golf hole.

14. The putting practice device according to claim 9 wherein said intermediate circular member is formed integrally with one of said upper member and said lower member.

* * * * *